US012565829B1

(12) United States Patent
Dong et al.

(10) Patent No.: US 12,565,829 B1
(45) Date of Patent: Mar. 3, 2026

(54) COMBINATION PARAMETER OPTIMIZATION DESIGN METHOD FOR FRACTURING AND PACKING DUAL-PARTICLE-SIZE PROPPANTS FOR UNCONSOLIDATED SANDSTONE RESERVOIR

(71) Applicant: China University of Petroleum (East China), Dongying (CN)

(72) Inventors: Changyin Dong, Dongying (CN); Zhendong Li, Dongying (CN); Honggang Liu, Dongying (CN); Jinyi Zhang, Dongying (CN); Zhangyu Li, Dongying (CN); Na Li, Dongying (CN); Jiayi Ren, Dongying (CN); Chuwei Zhang, Dongying (CN)

(73) Assignee: China University of Petroleum (East China), Dongying (CN)

( * ) Notice: Subject to any disclaimer, the term of this patent is extended or adjusted under 35 U.S.C. 154(b) by 0 days.

(21) Appl. No.: 19/321,259

(22) Filed: Sep. 7, 2025

(30) Foreign Application Priority Data

Apr. 15, 2025 (CN) ..... 202510468330.1

(51) Int. Cl.
*E21B 43/267* (2006.01)
*E21B 41/00* (2006.01)

(52) U.S. Cl.
CPC ..... *E21B 43/267* (2013.01); *E21B 41/00* (2013.01)

(58) Field of Classification Search
CPC ..... E21B 43/267
See application file for complete search history.

(56) References Cited

U.S. PATENT DOCUMENTS

2022/0090495 A1* 3/2022 Lu ..... E21B 49/00

FOREIGN PATENT DOCUMENTS

CN 119616442 A 3/2025

OTHER PUBLICATIONS

Title of the Item: Petroleum Exploration and Development Publication Date: Dec. 2019 Name of the Author: Dong Changyin et al. Article Title: Effects of fluid flow rate and viscosity on gravel-pack plugging and the optimization of sand-control wells production.

(Continued)

*Primary Examiner* — William D Hutton, Jr.
*Assistant Examiner* — Avi T Skaist
(74) *Attorney, Agent, or Firm* — Nitin Kaushik

(57) ABSTRACT

This disclosure belongs to the oil and gas exploitation industry, and specifically relates to a combination parameter optimization design method for fracturing and packing dual-particle-size proppants for an unconsolidated sandstone reservoir. According to this disclosure, specific parameters of proppants including a packing particle size, a packing fracture length ratio, and a packing sequence are subjected to optimization design based on reservoir and oil well conditions, as well as corresponding dual-particle-size combination modes. Ultimately, comprehensive effects of realizing effective sand blocking, reducing invasion, blockage, and permeability damage of formation sand to a fracture packing layer, reducing fracture flow resistance, improving comprehensive conductivity, and releasing a production capacity of oil and gas wells are achieved.

10 Claims, 6 Drawing Sheets

(56) References Cited

OTHER PUBLICATIONS

Title of the Item: Petroleum Explorati0n and Development Publication Date: Dec. 2017 Name of the Author: Li Yanlong et al. Article Title: Gravel sizing method for sand control packing in hydrate production test wells pp. 961-966.
Title of the Item: China University of Petroleum Master Degree Thesis Publication Date: Jun. 10, 2019 Name of the Author: Xuhui Guan Article Title: Research on Influence of Fine Migration in Shaly Loose Sandstone Reservoir on Fracture Conductivity during Production.

* cited by examiner

COMBINATION PARAMETER OPTIMIZATION DESIGN METHOD FOR FRACTURING AND PACKING DUAL-PARTICLE-SIZE PROPPANTS FOR UNCONSOLIDATED SANDSTONE RESERVOIR

CROSS-REFERENCE TO RELATED APPLICATIONS

The application claims priority to Chinese patent application No. 2025104683301, filed on Apr. 15, 2025, the entire contents of which are incorporated herein by reference.

TECHNICAL FIELD

This disclosure belongs to the oil and gas exploitation industry, and specifically relates to a combination parameter optimization design method for fracturing and packing dual-particle-size proppants for an unconsolidated sandstone reservoir.

BACKGROUND

Fracturing and packing is a sand control and production increasing technology commonly used in medium-to-high permeability unconsolidated sandstone oil and gas reservoirs prone to sanding. It involves forming fractures in unconsolidated sandstone reservoirs by means of hydraulic fracturing, and packing solid-phase particle materials such as conventional quartz sand or artificial ceramsite as proppants in the fractures to form high-conductivity fractures supported by the proppants (as shown in FIG. 1). The high-conductivity fractures serve as main channels for reservoir fluids to flow into a wellbore, playing a role in increasing production. Meanwhile, solid-phase particles packed in the fractures have a sand blocking effect, thus achieving a sand control function.

In conventional fracturing and packing proppants for medium-to-high permeability reservoirs, the artificial ceramsite is mostly used in offshore oil fields, while the conventional quartz sand is more commonly used in onshore oil fields with less application of the artificial ceramsite. Generally, a single particle size is adopted for the fracturing and packing design of the same well. At present, the particle sizes of the proppants used in the field mainly include three types: 0.3-0.6 mm, 0.4-0.8 mm and 0.6-1.2 mm.

Since the medium-to-high permeability unconsolidated sandstone is prone to sanding, the design and implementation of fracturing and packing for the reservoirs requires that the proppants in the fractures have a sand blocking function and can effectively block formation sand from invading the fractures. Meanwhile, the formation sand invading the fractures may cause blockage and fracture conductivity loss, adversely affecting the production capacity. Therefore, for the fracturing and packing for the medium-to-high permeability unconsolidated sandstone, it is required to ensure both sand blocking capability and fracture conductivity (this is quite different from low-permeability reservoirs where no sanding occurs and only the conductivity needs to be maintained). Since existing single-particle-size proppants fail to meet the above requirements under certain reservoir conditions, a combined packing pattern using dual-particle-size proppants has been developed, which mainly includes three patterns: fine outside and coarse inside, coarse outside and fine inside, as well as fine and coarse blending (as shown in FIG. 2).

At present, during combined packing of the fracturing and packing dual-particle-size proppants for medium-to-high permeability unconsolidated sandstone reservoirs, although the above three combination patterns can be adopted, their specific design and implementation faces the following key problems:

(1) At present, there is a lack of methods for designing specific sizes of a coarse-particle-size proppant and a fine-particle-size proppant for the three combination patterns of coarse and fine particle sizes. Designing based on experience makes it difficult to fully consider reservoir geological conditions and production conditions to ensure sand control and production increasing effects. Therefore, there is an urgent need for a rapid and simple method that can design and select specific particle sizes of coarse and fine proppants based on particle sizes and characteristic parameters of formation sand, so as to improve the sand blocking and production increasing effects of a combination fracturing and packing process using the dual-particle-size proppants.

(2) At present, there is a lack of methods for designing packing lengths (ratios) and specific packing amounts of the coarse-particle-size proppant and the fine-particle-size proppant in the fractures. The medium-to-high permeability reservoirs have a wide range of permeability ratios. According to different reservoir permeabilities, fluidity, and fracture lengths, reservoir fluids may invade and block the fractures in various flow patterns, namely, mainly at the toe of the fracture, mainly at the root of the fracture, or mainly via uniform invasion. Under different flow patterns, the invasion and blockage morphologies of the formation sand on fracture packing layers are different. There is an urgent need to design packing positions of proppants with coarse and fine particle sizes in the fractures, as well as corresponding packing segment lengths and packing amounts, according to the key invasion sites and morphologies. This approach aims to give full play to the respective functions of the coarse-particle-size proppant and the fine-particle-size proppant and fully exert the sand control and production increasing effects of the dual-particle-size combination fracturing and packing process.

(3) At present, the fracturing and packing proppants commonly used for the medium-to-high permeability reservoirs in the field typically include three types: 0.3-0.6 mm, 0.4-0.8 mm, and 0.6-1.2 mm. Therefore, the optimization design result of fracturing and packing particle sizes can only be chosen one of the three. However, the intervals between these three particle sizes are relatively large, making it difficult to accurately match the particle size of the formation sand in accordance with the optimization matching criteria. This leads to excessive invasion and blockage or loss of fluidity, and restricts the effects of fracturing for increasing production and sand control.

SUMMARY

This disclosure proposes a combination parameter optimization design method for fracturing and packing dual-particle-size proppants for an unconsolidated sandstone reservoir. This method aims to perform optimization design on specific parameters of proppants including a packing particle size, a packing fracture length ratio, and a packing sequence based on reservoir and oil well conditions, as well as corresponding dual-particle-size combination modes, which ultimately achieves comprehensive effects of realizing effective sand blocking, reducing invasion, blockage, and permeability damage of formation sand to a fracture packing layer, reducing fracture flow resistance, improving comprehensive conductivity, and releasing a production capacity of oil and gas wells. Among them, the purpose of performing optimization design on the packing length ratio and the packing amount of the dual-particle-size proppants is to design corresponding packing fracture sites using coarse and fine proppants based on key invasion and blockage sites of the formation sand to the fracture, thereby achieving a balance between overall sand blocking and flow diversion in the fracture. This ensures that a combined packing technology using the coarse-particle-size proppant and the fine-particle-size proppant can realize its potential and effect, thereby enhancing sand control and production increasing effects. The purpose of performing optimization design on particle sizes of the dual-particle-size proppants for a fracturing and packing well is to design the particle sizes based on particle size characteristics of the formation sand, ensuring that a ratio of the particle size of the fracturing and packing proppant to the particle size of the formation sand is always within an optimal range. This ensures the sand blocking effect while avoiding damage to the fracture conductivity and production capacity caused by excessive formation sand invasion.

This disclosure provides a combination parameter optimization design method for fracturing and packing dual-particle-size proppants for an unconsolidated sandstone reservoir, including:

S1, calculating an invasion site discrimination feature index:

first, evaluating a severity degree of sanding based on formation parameters and production conditions; and then, calculating a discrimination feature index (Fracture Sand Invasion, $F_{SI}$ index) of fracturing and packing formation sand for a fracture invasion site.

S2, Optimizing a packing sequence and a fracture length ratio of dual-particle-size proppants for a fracturing and packing well:

dividing an invasion and blockage area of formation sand to a fracture into a slight invasion area and a severe invasion area based on the $F_{SI}$ index calculated in step S1, so as to distinguish flow patterns of a reservoir fluid and the formation sand towards the fracture; and obtaining a packing sequence and a fracture length ratio of a coarse-particle-size proppant and a fine-particle-size proppant based on the $F_{SI}$ index calculated in step S1.

Preferably, volume dosages of coarse and fine proppants are calculated based on the packing fracture length ratio between the coarse-particle-size proppant and the fine-particle-size proppant and fracture geometry parameters.

S3, Optimizing combined coarse and fine particle sizes of the dual-particle-size proppants for the fracturing and packing well:

calculating a design value of a median particle size of the fine-particle-size proppant based on a severity degree of sanding of the formation sand, a median particle size of the formation sand, and a uniformity coefficient, so as to optimize design of the particle sizes of the proppants.

In step S1, the formation parameters include a reservoir thickness, an original permeability, and a geometrical dimension for a fracture scale.

In step S2, the severe invasion area refers to a fracture site where when the reservoir fluid and the formation sand inflow non-uniformly towards the fracture, an inflow rate is relatively high, the formation sand invades relatively quickly, and a relatively severe blockage degree of the packing proppant is caused, with a length of the fracture site in the fracture being designated as $L_{fa}$.

The slight invasion area refers to a fracture site where when the reservoir fluid and the formation sand inflow non-uniformly towards the fracture, an inflow rate is relatively low, the formation sand invades relatively slowly, and a relatively slight blockage degree of the packing proppant is caused, with a length of the fracture site in the fracture being designated as $L_{fb}$.

Based on reservoir geological conditions, fracture geometry parameters and conductivity, production conditions, and other characteristics, there are two patterns for relative positions of the slight invasion area and the severe invasion area:

a pattern A: as shown in FIG. 3, an area near a toe of the fracture is the severe invasion area, and an area near a root of the fracture is a slight invasion area;

a pattern B: as shown in FIG. 4, an area near the root of the fracture is the severe invasion area, and an area near the toe of the fracture is the slight invasion area.

Scientific principles and basis for dividing the above-mentioned invasion areas are as follows: fracturing and packing have a relatively high permeability and conductivity (a product of a fracture width and a packing permeability), enabling the fluid in the reservoir to flow more easily in the fracture. Unlike low-permeability reservoirs where a reservoir permeability is extremely low and reservoir flow mainly enters the fracture in a bilinear flow pattern with uniform inflow, a medium-to-high permeability unconsolidated sandstone reservoir itself has a relatively high permeability, and the fluid has a certain flow capacity within the reservoir itself. Therefore, in a medium-to-high permeability unconsolidated sandstone fracture-reservoir flow system, the reservoir fluid close to the fracture flows towards the fracture, while part of the fluid further from the fracture flows towards a well in the reservoir, forming a relatively complex flow pattern. This results in that flow of the reservoir carrying the formation sand towards the fracture is generally not uniform inflow, but non-uniform inflow. Based on specific flow conditions and characteristics, the area can be divided into the slight invasion area and the severe invasion area.

Furthermore, if the fracture length is relatively short compared to a reservoir control radius, the fracture has excellent conductivity, with liquidity much higher than that of the reservoir, the fluid is more likely to preferentially flow into the fracture from a toe position of the fracture, forming a scenario of the pattern A (as shown in FIG. 3); and on the contrary, a scenario of the pattern B is more likely to form (as shown in FIG. 4).

For the flow of the pattern A and the pattern B, if the length $L_{fb}$ of the slight invasion area and the length $L_{fa}$ of the severe invasion area can be obtained, the packing lengths and dosages of the coarse and fine proppants can be designed.

Specifically, a combination parameter optimization design method for fracturing and packing dual-particle-size proppants for an unconsolidated sandstone reservoir, including:

S1, calculating the invasion site discrimination feature index.

S101, Evaluating a severity degree of sanding, and obtaining a sanding inflow invasion index of a reservoir of the fracturing and packing well towards the fracture.

The sanding inflow (Sanding Inflow, $S_I$) invasion index characterizes the severity degree of sanding when the reservoir of the fracturing and packing well flows towards the fracture, with a calculation formula as follows:

$$S_I = 0.75 \times \frac{\Delta P}{\Delta P_c} + 0.25 \times \frac{B_{sc}}{B_s}; \quad (1)$$

in the above formula, $\Delta P$ is an average production pressure difference of an oil well, MPa; $\Delta P_c$ is a critical production pressure difference for sanding of the oil well, which is calculated by sanding prediction, MPa; $B_s$ is a sanding index of the reservoir, $MP^2$; $B_{sc}$ is a boundary of a sanding index corresponding to severe sanding in empirical qualitative sanding prediction, with a value of $1.5\times10^4$ $MPa^2$; and $S_I$ is the sanding inflow invasion index, which is dimensionless.

$S_I$ is an index with a value around 1. The larger the value of $S_I$ above 1, the more severe the sanding inflow invasion from the reservoir towards the fracture; and the smaller the value of $S_I$ below 1, the weaker the sanding inflow invasion from the reservoir towards the fracture.

The scientificity and rationality for calculating the above-mentioned $S_I$ index lies in that: the sanding index characterizes the risk of sanding based on the reservoir geological conditions and physical properties of rock strength. The higher a $B_{sc}/B_s$ ratio, the higher the risk of sanding considered from a reservoir geological perspective; and a weight thereof is relatively weak, with a value of 0.25. On the other hand, the severity degree of sanding depends more on a comparison between an actual production pressure difference and the critical pressure difference for sanding. The greater an excess of the former over the latter, the more severe the actual sanding degree; the higher a ratio $\Delta P/\Delta P_c$, the more severe the sanding inflow invasion from the reservoir towards the fracture; and a weight thereof is relatively large, with a value of 0.75.

S102, Calculating the invasion site discrimination feature index (Fracture Sand Invasion, $F_{SI}$ index) to evaluate and determine the relative positions of the slight invasion area and the severe invasion area that the fluid and the formation sand flow towards the fracture as well as a boundary position thereof.

The $F_{SI}$ index is:

$$F_{SI}=S_I\times(W_{Lf}X_{Lf}+W_{hf}X_{hf}+W_{kwf}X_{kwf}) \quad (5);$$

in the formula, $F_{SI}$ is the invasion site discrimination feature index, which is dimensionless; $X_{Lf}$, $X_{hf}$, and $X_{kwf}$ are a single impact factor for a fracturing and packing fracture length, a single impact factor for a fracturing and packing fracture height, and a single impact factor for fracturing and packing fracture conductivity, respectively, which are dimensionless; and $W_{Lf}$, $W_{hf}$, and $W_{kwf}$ are weight coefficients of the single impact factor for the fracture length, the single impact factor for the fracture height, and an impact factor for the conductivity, respectively.

Preferably, values of $W_{Lf}$, $W_{hf}$, and $W_{kwf}$ are 0.45±0.02, 0.25±0.02, and 0.3±0.02, respectively.

The single impact factor for the fracturing and packing fracture length $X_{Lf}$ is:

$$X_{Lf} = \alpha \cdot \frac{R_e - L_f}{R_e}; \quad (2)$$

in the formula, $X_{Lf}$ is the single impact factor for the fracturing and packing fracture length, which is dimensionless; $R_e$ is a reservoir radius controlled by the oil well, m; $L_f$ is a single-wing fracture length of the fracture, m; and $\alpha$ is a correction coefficient for the fracturing and packing fracture length.

The correction coefficient for the fracturing and packing fracture length $\alpha$ is used to perform weighted averaging with other single impact factors in the same order of magnitude.

Preferably, a value of the correction coefficient for the fracturing and packing fracture length $\alpha$ is 1.5385.

The smaller the single impact factor for the fracturing and packing fracture length $X_{Lf}$, the shorter the fracture compared to the reservoir radius controlled by the oil well, and the more the flow of the reservoir fluid towards the fracture tending to be the pattern B; and on the contrary, the more the flow tending to be the pattern A.

The single impact factor for the fracturing and packing fracture height $X_{hf}$ is:

$$X_{hf} = \beta \cdot \frac{h_f}{H_e}; \quad (3)$$

in the formula, $X_{hf}$ is the single impact factor for the fracturing and packing fracture height, which is dimensionless; $H_e$ is a reservoir thickness, m; $h_f$ is a fracture height, m; and $\beta$ is a correction coefficient for the fracturing and packing fracture height.

The correction coefficient for the fracturing and packing fracture height $\beta$ is used to perform weighted averaging with other single impact factors in the same order of magnitude.

Preferably, a value of the correction coefficient for the fracturing and packing fracture height $\beta$ is 1.058.

The smaller the single impact factor for the fracturing and packing fracture height $X_{Lf}$, the shorter the fracture height compared to the reservoir thickness, and the more the flow of the reservoir fluid towards the fracture tending to be the pattern B; and on the contrary, the more the flow tending to be the pattern A.

The single impact factor for the fracturing and packing fracture conductivity $X_{kwf}$ is:

$$X_{kwf} = \gamma \cdot \left(\frac{k_f}{K_e}\right)^{0.25} \cdot \left(\frac{w_f}{0.5\pi R_e}\right)^{0.25}; \quad (4)$$

in the formula, $X_{kwf}$ is the single impact factor for the fracturing and packing conductivity, which is dimensionless; $K_e$ is a reservoir permeability, D; $k_f$ is a fracture packing permeability, D; $w_f$ is a fracture width, mm; and $\gamma$ is a correction coefficient for the fracturing and packing fracture conductivity.

The correction coefficient for the fracturing and packing fracture conductivity $\gamma$ is used to perform weighted averaging with other single impact factors in the same order of magnitude.

Preferably, a value of the $\gamma$ is 2.15.

The smaller the single impact factor for the fracturing and packing fracture conductivity $X_{kwf}$ is, the closer the fracture conductivity is to the reservoir fluidity, and the less likely the reservoir fluid is to flow towards the fracture. Instead, it is more likely to flow towards the root of the fracture, i.e., it tends more to the pattern B; and on the contrary, it tends more to the pattern A.

S2, Optimizing a packing sequence and a fracture length ratio of dual-particle-size proppants for a fracturing and packing well:

S201, determining flow patterns of a reservoir fluid and the formation sand towards the fracture based on the $F_{SI}$ index:

if $F_{SI}>1.15$, the flow pattern of the reservoir fluid and the formation sand towards the fracture being a pattern A;

if $F_{SI}<0.85$, the flow pattern of the reservoir fluid and the formation sand towards the fracture being a pattern B; and if $0.85 \leq F_{SI} \leq 1.15$, the flow pattern of the reservoir fluid and the formation sand towards the fracture tending to uniform flow, being neither the pattern A nor the pattern B.

According to the definition and characteristics of the $F_{SI}$ index, when the $F_{SI}$ index is greater than 1.15, the flow pattern is manifested as the pattern A. The higher the $F_{SI}$ index is, the more obvious the degree to which a flow invasion pattern tends to the pattern A, and a boundary line between an internal slight invasion area near a direction of the wellbore and an external severe invasion area near a direction of the reservoir moves further outwards. In order to achieve a balance and optimal effect between sand blocking and blockage, the coarse-particle-size proppant is used to pack the internal slight invasion area, and the fine-particle-size proppant is used to pack the external severe invasion area. Correspondingly, as the $F_{SI}$ index increases, a packing section of the internal coarse-particle-size proppant becomes longer, and a packing length of the external fine-particle-size proppant becomes shorter.

Similarly, when the $F_{SI}$ index is less than 0.85, the flow pattern is manifested as the pattern B. The lower the $F_{SI}$ index is, the more obvious the degree to which the flow invasion pattern tends to the pattern B, and a boundary line between an internal severe invasion area near the direction of the wellbore and an external slight invasion area near the direction of the reservoir moves further inwards (in the direction of the wellbore). A packing section of the internal fine-particle-size proppant becomes shorter, and a packing length of the external coarse-particle-size proppant becomes longer.

S202, Designing a packing fracture length ratio and a packing sequence of the coarse-particle-size proppant and the fine-particle-size proppant based on the flow patterns and the $F_{SI}$ index:

proposing a design method for a packing fracture length ratio of the coarse-particle-size proppant and the fine-particle-size proppant according to the above principles, as shown in Table 1; where the packing sequence is based on a rule of packing the fine-particle-size proppant in the severe invasion area and packing the coarse-particle-size proppant in the slight invasion area.

TABLE 1

Design method for the packing fracture length ratio of the coarse-particle-size proppant and the fine-particle-size proppant

| Serial number | FsI index | Flow pattern | Schematic diagram of packing with the coarse-particle-size proppant and the fine-particle-size proppant | Packing fracture length ratio (the coarse-particle-size proppant: the fine-particle-size proppant) | Packing fracture length of the coarse and fine proppants |
|---|---|---|---|---|---|
| 1 | $2.0 < F_{SI}$ | Pattern A | FIG. 5(a) | 7:3 | $L_{fa} = 0.3\ L_f$<br>$L_{fb} = 0.7\ L_f$ |
| 2 | $1.75 < F_{SI} \leq 2.0$ | Pattern A | FIG. 5(b) | 6:4 | $L_{fa} = 0.4\ L_f$<br>$L_{fb} = 0.6\ L_f$ |
| 3 | $1.55 < F_{SI} \leq 1.75$ | Pattern A | FIG. 5(c) | 5:5 | $L_{fa} = 0.5\ L_f$<br>$L_{fb} = 0.5\ L_f$ |
| 4 | $1.25 < F_{SI} \leq 1.55$ | Pattern A | FIG. 5(d) | 4:6 | $L_{fa} = 0.6\ L_f$<br>$L_{fb} = 0.4\ L_f$ |
| 5 | $1.15 < F_{SI} \leq 1.25$ | Pattern A | FIG. 5(e) | 3:7 | $L_{fa} = 0.7\ L_f$<br>$L_{fb} = 0.3\ L_f$ |
| 6 | $0.85 \leq F_{SI} \leq 1.15$ | Uniform inflow | Not applicable to this disclosure | Not applicable to this disclosure | |
| 7 | $0.7 \leq F_{SI} < 0.85$ | Pattern B | FIG. 6(a) | 3:7 | $L_{fa} = 0.7\ L_f$<br>$L_{fb} = 0.3\ L_f$ |
| 8 | $0.55 \leq F_{SI} < 0.7$ | Pattern B | FIG. 6(b) | 4:6 | $L_{fa} = 0.6\ L_f$<br>$L_{fb} = 0.4\ L_f$ |
| 9 | $0.4 \leq F_{SI} < 0.55$ | Pattern B | FIG. 6(c) | 5:5 | $L_{fa} = 0.5\ L_f$<br>$L_{fb} = 0.5\ L_f$ |
| 10 | $0.25 \leq F_{SI} < 0.4$ | Pattern B | FIG. 6(d) | 6:4 | $L_{fa} = 0.4\ L_f$<br>$L_{fb} = 0.6\ L_f$ |
| 11 | $F_{SI} < 0.25$ | Pattern B | FIG. 6(e) | 7:3 | $L_{fa} = 0.3\ L_f$<br>$L_{fb} = 0.7\ L_f$ |

S3, Optimizing combined coarse and fine particle sizes of the dual-particle-size proppants for the fracturing and packing well:

designing specific particle sizes of the coarse-particle-size proppant and the fine-particle-size proppant based on a severity degree of sanding of a formation, a median particle size of the formation sand, and a uniformity coefficient, where under a combined packing pattern of fracturing and packing with the coarse-particle-size proppant and the fine-particle-size proppant, the fine-particle-size proppant mainly plays a role in sand blocking, and the design method for the median particle size thereof is:

$$D_{g50a} = (S_I)^{-0.5} \cdot \left(\frac{J_s}{5.0}\right)^{-0.25} \cdot 5.5 \cdot d_{s50}; \tag{6}$$

in the formula, $S_I$ is the sanding inflow invasion index of the reservoir to the fracture, which is dimensionless; $J_s$ is the uniformity coefficient of the formation sand, which is dimensionless; $d_{s50}$ is the median particle size of the formation sand, mm; and $D_{g50a}$ is the design value of the median particle size of the fine-particle-size proppant, mm.

When $D_{g50a}<0.3$, selecting the fine-particle-size proppant with a particle size of 0.3-0.6 mm, and selecting the coarse-particle-size proppant with a particle size of 0.3-0.6 mm;

when $0.3 \leq D_{g50a} < 0.6$, selecting the fine-particle-size proppant with a particle size of 0.3-0.6 mm, and selecting the coarse-particle-size proppant with a particle size of 0.4-0.8 mm;

when $0.6 \leq D_{g50a} < 0.8$, selecting the fine-particle-size proppant with a particle size of 0.4-0.8 mm, and selecting the coarse-particle-size proppant with a particle size of 0.6-1.2 mm; and when $0.8 \leq D_{g50a}$, selecting the fine-particle-size proppant with a particle size of 0.6-1.2 mm, and selecting the coarse-particle-size proppant with a particle size of 0.6-1.2 mm.

For example, the traditional Saucier method designs particle sizes of proppants based on the median particle size of a sand blocking proppant being 5-6 times the median particle size of the formation sand, without considering production and sanding conditions. This approach, which only considers the median particle size of the formation sand, makes it difficult to balance the production capacity and the sand control effect. However, this disclosure not only considers the median particle size of the formation sand, but also considers the severity degree of sanding and the uniformity coefficient of the formation sand. This ensures the sand blocking effect while avoiding damage to the fracture conductivity and production capacity caused by excessive formation sand invasion.

The principle of optimizing the particle sizes of the dual-particle-size proppants for the fracturing and packing well is as follows: the more severe the sanding, the more difficult it is to block, and the easier it is for the formation sand to invade a fracture packing zone, causing blockage and production capacity loss; the poorer the uniformity of the formation sand (the higher the uniformity coefficient), the more difficult it is to block. Finer proppant particle sizes should be used under the above two trends; and otherwise, coarser proppant particle sizes should be selected.

Beneficial Effects (1) This disclosure proposes a combination parameter optimization design method for fracturing and packing dual-particle-size proppants for an unconsolidated sandstone reservoir. This method can perform optimization design on specific parameters of proppants including a packing particle size, a packing fracture length ratio, and a packing sequence based on the selected reservoir and oil well conditions, as well as corresponding dual-particle-size combination modes, which ultimately achieves comprehensive effects of realizing effective sand blocking, reducing invasion, blockage, and permeability damage of formation sand to a fracture packing layer, reducing fracture flow resistance, improving comprehensive conductivity, and releasing a production capacity of oil and gas wells.

(2) According to this disclosure, the particle sizes of the coarse-particle-size proppant and the fine-particle-size proppant are designed and selected based on the particle size of the formation sand and characteristic indicators thereof; a blending ratio of the coarse and fine proppants can be designed according to the particle size characteristics of the formation sand; and the problem that intervals between three proppant particle sizes commonly used in sites of oil and gas fields are relatively large, making it difficult to cover part of the particle size of the formation sand with an optimal particle size ratio can be solved. In general, a ratio of the particle size of the fracturing and packing proppant to the particle size of the formation sand is ensured to be always within an optimal range. This ensures the sand blocking effect while avoiding damage to the fracture conductivity and production capacity caused by excessive formation sand invasion.

(3) According to this disclosure, a method for a packing length ratio and corresponding packing amounts of coarse and fine proppants in a fracture is proposed aiming at two combination patterns of the coarse and fine proppants: coarse outside and fine inside, and fine outside and coarse inside. This method fully considers the influence of the reservoir geological conditions, the fracture geometry parameters, and production fluid conditions on the key invasion site of the formation sand to the fracture, and designs corresponding packing fracture sites using the coarse and fine proppants based on key invasion and blockage sites. This method achieves the effects of "fine particle size for sand blocking, coarse particle size for flow diversion", gives full play to the respective functions of the coarse-particle-size proppant and the fine-particle-size proppant, achieves a balance between overall sand blocking and flow diversion of the fracture, ensures that the combined packing technology using the coarse-particle-size proppant and the fine-particle-size proppant can realize its potential and effect, thereby enhancing sand control and production increasing effects.

Figure 1:
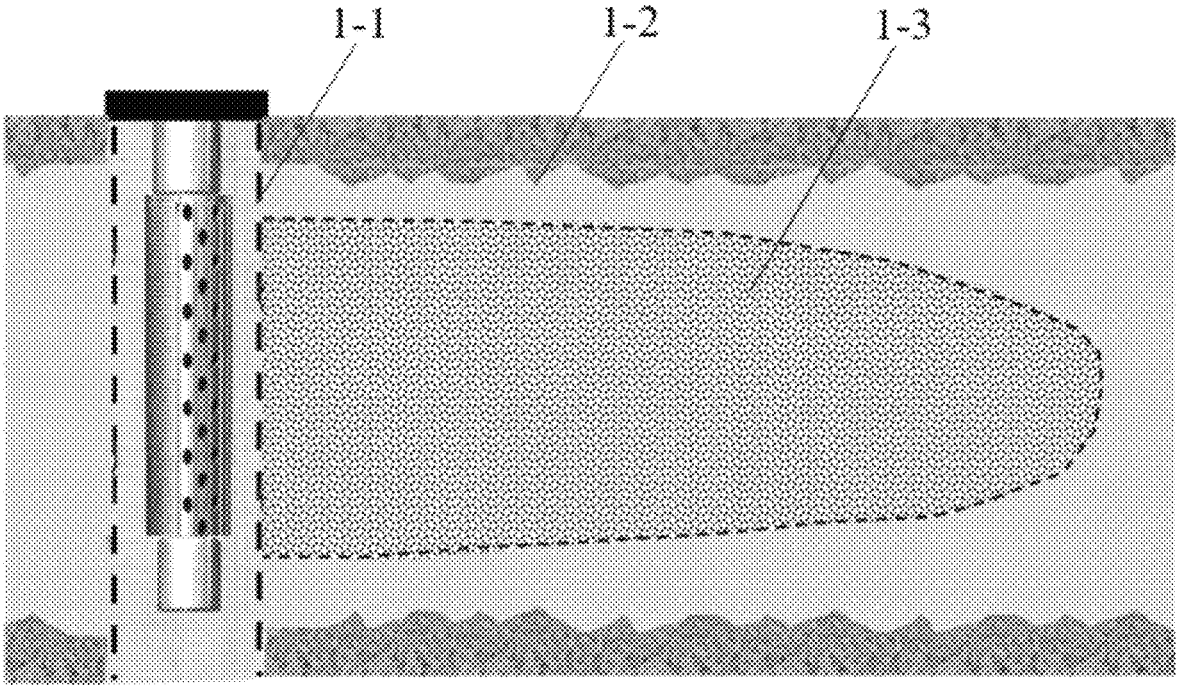
FIG. 1 is a schematic diagram of fracturing and packing of a single-particle-size proppant.
Figure 2:
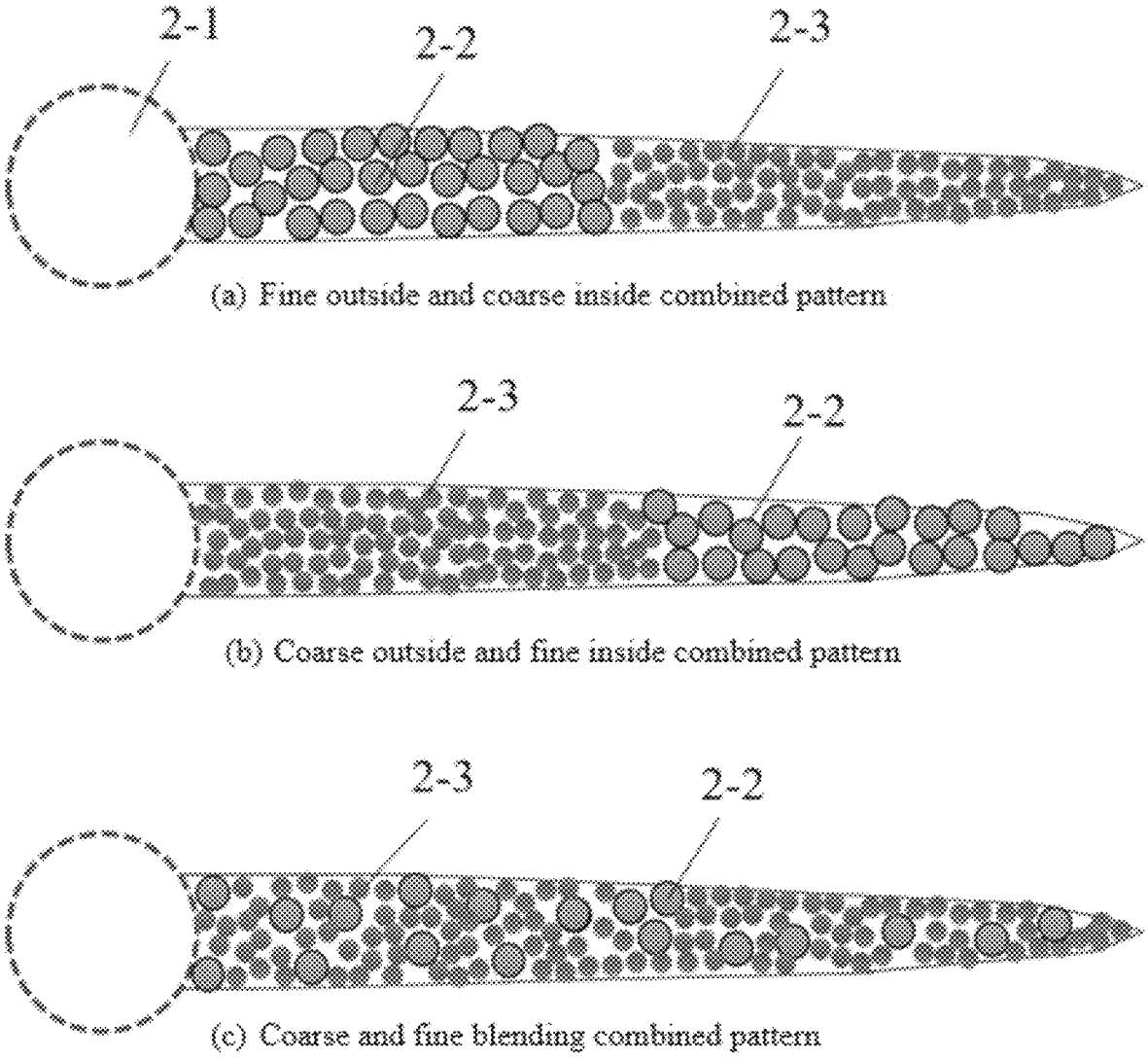
FIG. 2 is a schematic diagram of three combination patterns of dual-particle-size proppants.
Figure 3:
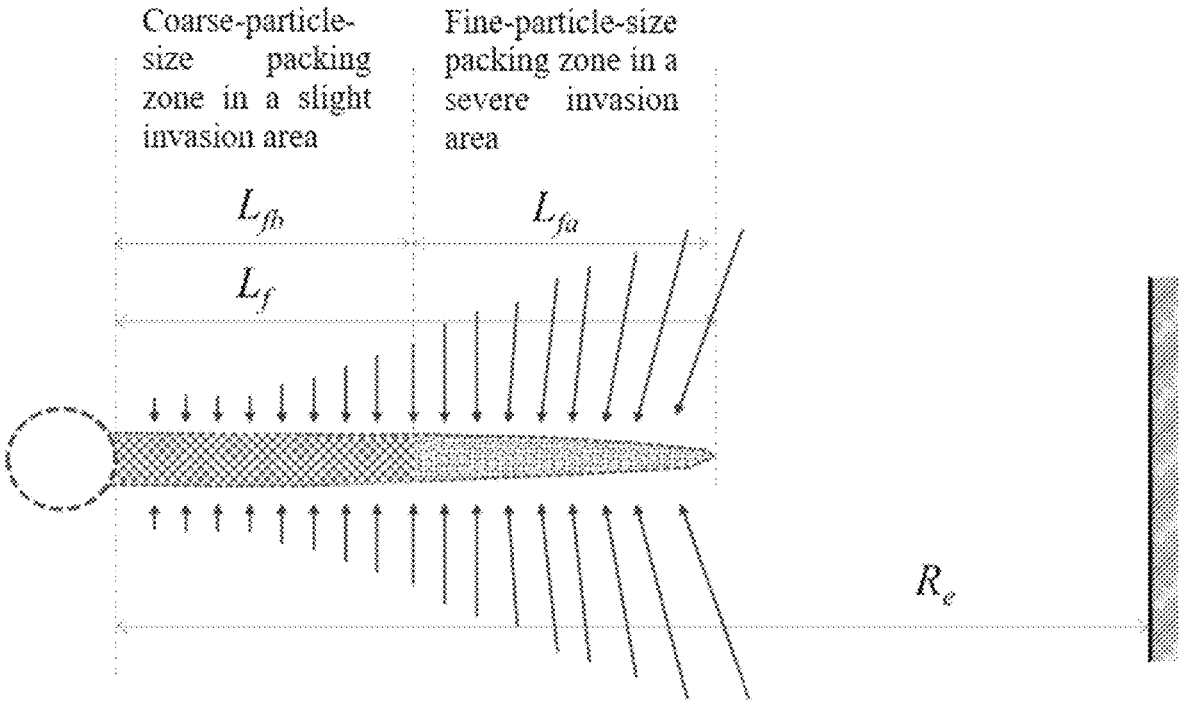
FIG. 3 is a schematic diagram of packing where flow of a reservoir fluid and formation sand towards a fracture is manifested as a pattern A.
Figure 4:
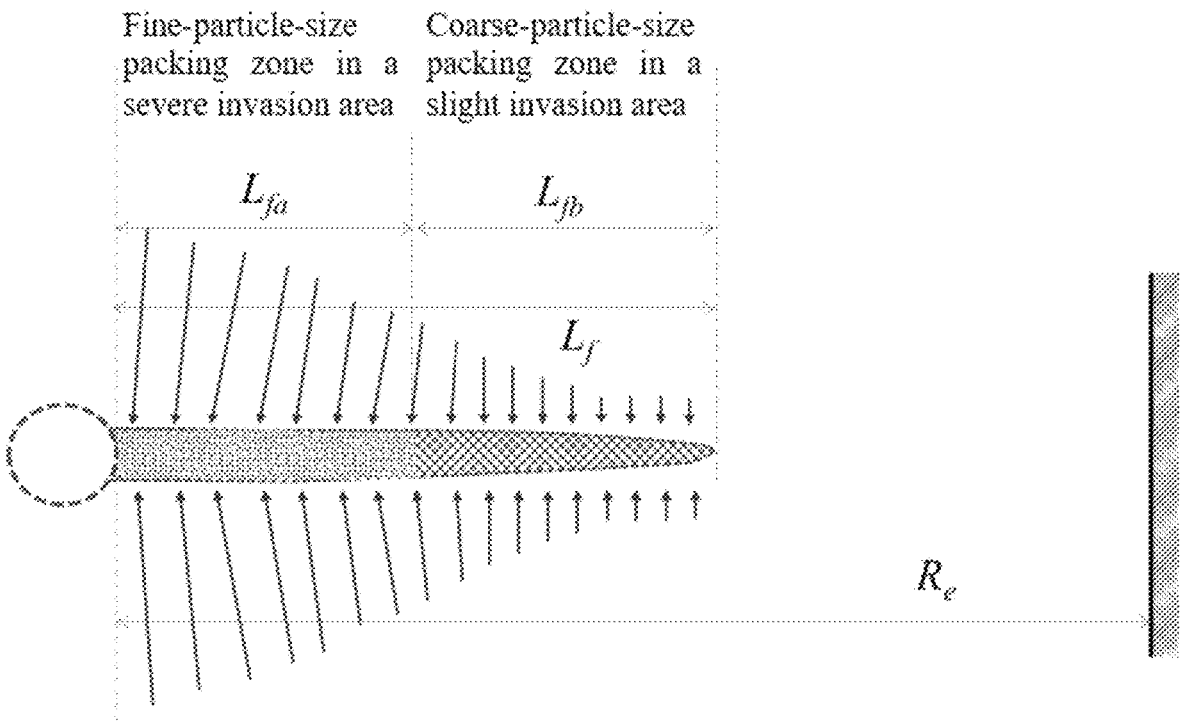
FIG. 4 is a schematic diagram of packing where flow of a reservoir fluid and formation sand towards a fracture is manifested as a pattern B.
Figure 5:
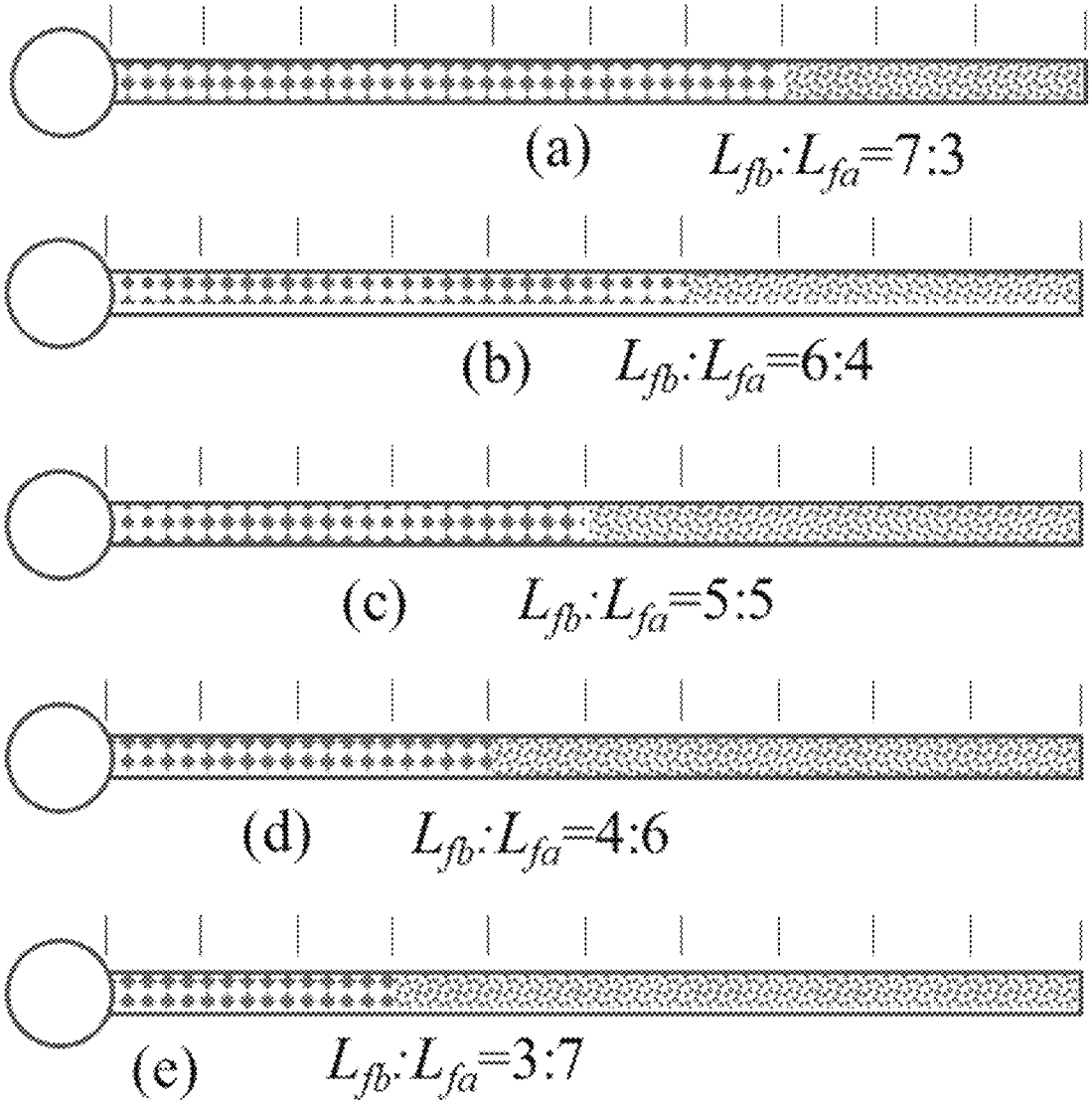
FIG. 5 is a schematic diagram of a packing ratio where flow of a reservoir fluid and formation sand towards a fracture is manifested as a pattern A.
Figure 6:
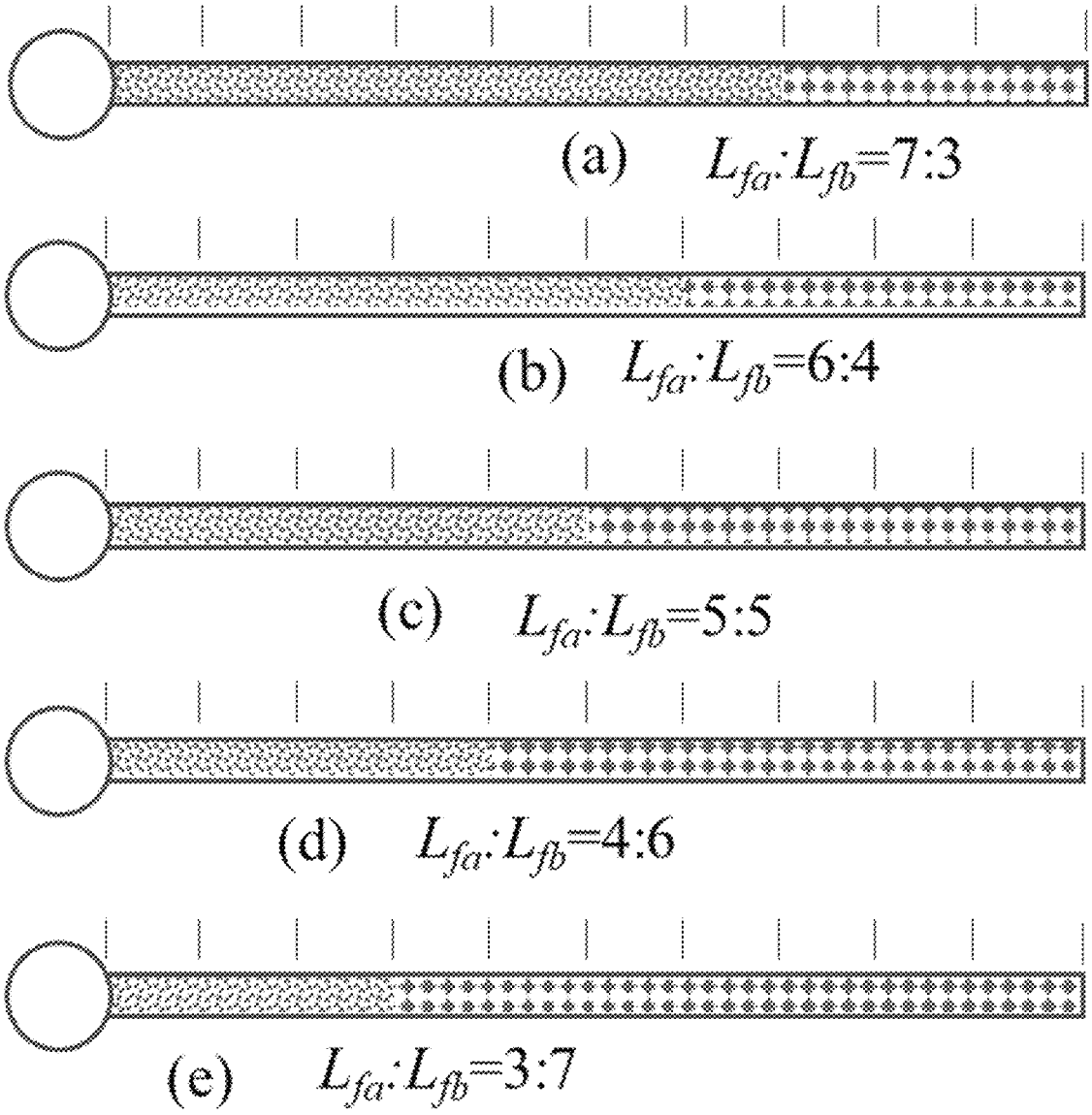
FIG. 6 is a schematic diagram of a packing ratio where flow of a reservoir fluid and formation sand towards a fracture is manifested as a pattern B.

In the figures: 1-1 is a wellbore, 1-2 is a reservoir, 1-3 is a proppant packed fracture, 2-1 is a wellbore, 2-2 is a coarse-particle-size proppant, and 2-3 is a fine-particle-size proppant.

DETAILED DESCRIPTION OF THE EMBODIMENTS

Example 1

There is currently an oil well with loosely cemented geology, belonging to an unconsolidated sandstone oil and gas reservoir. A reservoir radius $R_e$ controlled by the oil well is 200 m, and an average production pressure difference $\Delta P$ of the oil well is 4.2 MPa. According to sanding prediction, a critical production pressure difference for sanding $\Delta P_c$ of the oil well is 4 MPa, a sanding index $B_s$ of a reservoir is $1.6 \times 10^4$ $MPa^2$, and the oil well as a whole shows a sanding state. Dual-particle-size packing and fracturing construction is currently adopted.

A prediction method for the critical production pressure difference $\Delta P_c$ for sanding of the oil well refers to Dong Changyin, Theory and Technology of Sand Control in Oil and Gas Wells [M], China University of Petroleum Press, 2012:45.

The boundaries for severe sanding, slight sanding, and no sanding in empirical qualitative sanding prediction refer to the combined modulus method, with specific reference to Dong Changyin, Theory and Technology of Sand Control in Oil and Gas Wells [M], China University of Petroleum Press, 2012:32.

S101, Calculating a sanding inflow (Sanding Inflow, $S_I$) invasion index

Based on given data and a formula (1), performing calculation to obtain that $S_I$ is 1.054, and preliminarily determining that the sanding inflow invasion of the reservoir towards the fracture is severe.

S102, Calculating $F_{SI}$

Based on formulas (2), (3), and (4), calculating a single impact factor for a fracturing and packing fracture length $X_{Lf}$, a single impact factor for a fracturing and packing fracture height $X_{hf}$, and a single impact factor for fracturing and packing fracture conductivity $X_{kwf}$, with calculation conditions and results shown in Table 2.

TABLE 2

Calculation conditions and results

| | Calculation conditions | | | | Calculation results |
|---|---|---|---|---|---|
| Single impact factor for a fracturing and packing fracture length $X_{Lf}$ | α | $R_e$/m | $L_f$/m | \ | $X_{Lf}$ |
| | 1.5385 | 200 | 35 | \ | 1.27 |
| Single impact factor for a fracturing and packing fracture height $X_{hf}$ | β | $h_f$/m | $H_e$/m | \ | $X_{hf}$ |
| | 1.058 | 15.8 | 20 | \ | 0.84 |
| Single impact factor for fracturing and packing fracture conductivity $X_{kwf}$ | γ | $k_f$/D | $K_e$/D | $w_f$/mm | $X_{kwf}$ |
| | 2.15 | 5 | 0.36 | 11 | 1.8 |

In this example, weight coefficients $W_{Lf}$, $W_{hf}$, and $W_{kwf}$ of the single impact factor for the fracturing and packing fracture length, the single impact factor for the fracturing and packing fracture height, and the impact factor for the fracturing and packing conductivity take values of 0.45, 0.25, and 0.3, respectively. A value of the $F_{SI}$ index is calculated to be 1.32 using a formula (5).

S201, Since the $F_{SI}$ index is greater than 1.15, determining that a flow pattern of a reservoir fluid and formation sand towards a fracture is a pattern A.

S202, Based on the flow pattern, determining that a packing sequence of coarse and fine proppants is coarse inside and fine outside; and based on the $F_{SI}$ index, determining that a packing fracture length ratio of a coarse-particle-size proppant and a fine-particle-size proppant is 4:6.

S3, Optimizing combined coarse and fine particle sizes of dual-particle-size proppants A uniformity coefficient $J_s$ of formation sand of the reservoir being 2.25, a median particle size $d_{s50}$ of the formation sand being 0.1 mm, and a design value of a median particle size $D_{g50a}$ of the fine-particle-size proppant being calculated to be 0.65 using a formula (6).

Since $0.6 \leq D_{g50a} < 0.8$, selecting the fine-particle-size proppant with a particle size of 0.4-0.8 mm, and selecting the coarse-particle-size proppant with a particle size of 0.6-1.2 mm.

Based on a total length of the fracturing and packing fracture length being 35 m, performing calculation to obtain that a packing length of the coarse-particle-size proppant is 14 m, and a packing length of the fine-particle-size proppant is 21 m.

In summary, the design results are as follows: according to a design scheme of coarse inside and fine outside, the coarse-particle-size proppant with a size of 0.6-1.2 mm is packed near a wellbore end, with a packing length of 14 m; and then, the fine-particle-size proppant with a size of 0.4-0.8 mm is continued to be packed, with a packing length of 21 m.

Comparative Example 1

This comparative example designs particle sizes of proppants based on the median particle size of a sand blocking proppant being 5-6 times the median particle size of the formation sand according to the traditional Saucier method, where the particle size of the used proppant is 0.4-0.8 mm. Moreover, in this comparative example, a severe invasion area and a slight invasion area are not distinguished, and a single-particle-size proppant is used for packing.

TABLE 3

Comparison of effects between Example 1 and Comparative Example 1

| | Initial relative permeability/ ($\mu m^2$) | First sand production time/d | Stable sand content after sanding/ % | Production increasing effects before and after construction/ % |
|---|---|---|---|---|
| Example 1 | 12 | 220 | 0.08 | 82 |
| Comparative Example 1 | 15 | 150 | 0.16 | 78 |

The initial relative permeability is measured using a gas permeability meter. For dual-particle-size packing, a weighted averaging method is required, i.e., (a permeability of a section A×a length of the section A+a permeability of a section B×a length of the section B)/a total length of a fracture.

All of the initial sand production time, the stable sand content after sanding, and the production increasing effects before and after construction can be acquired from in-situ data, with samples taken from the Dongying Shengli Oil field.

Although the initial relative permeability of the proppant is slightly lower in dual-particle-size packing, results of field practice show that the dual-particle-size packing can significantly increase the initial sand production time of an oil well and the stable sand content after sanding, thereby achieving an adequate sand control effect while maintaining production stabilizing and increasing effects of the oil well.

What is claimed is:

1. A combination parameter optimization design method for fracturing and packing dual-particle-size proppants for an unconsolidated sandstone reservoir, comprising:

S1, calculating an invasion site discrimination feature index:

first, evaluating a severity degree of sanding based on formation parameters and production conditions; and then, calculating a discrimination feature index $F_{SI}$ of fracturing and packing formation sand for a fracture invasion site;

S2, optimizing a packing sequence and a fracture length ratio of dual-particle-size proppants for a fracturing and packing well:

distinguishing flow patterns of a reservoir fluid and the formation sand towards a fracture based on the $F_{SI}$ calculated in step S1; and obtaining a packing sequence and a fracture length ratio of a coarse-particle-size proppant and a fine-particle-size proppant; and

S3, optimizing combined coarse and fine particle sizes of the dual-particle-size proppants for the fracturing and packing well:

calculating a design value of a median particle size of the fine-particle-size proppant based on a severity degree of sanding of the formation sand, a median particle size of the formation sand, and a uniformity coefficient, so as to optimize design of the particle sizes of the proppants; wherein in step S1, a calculation method for the invasion site discrimination feature index comprises:

S101, obtaining a sanding inflow invasion index of a reservoir of the fracturing and packing well towards the fracture:

a calculation formula for the sanding inflow invasion index of the reservoir of the fracturing and packing well towards the fracture being:

$$S_I = 0.75 \times \frac{\Delta P}{\Delta P_c} + 0.25 \times \frac{B_{sc}}{B_s}; \quad (1)$$

in the above formula, $\Delta P$ is an average production pressure difference of an oil well, MPa; $\Delta P_c$ is a critical production pressure difference for sanding of the oil well, MPa; $B_s$ is a sanding index of the reservoir, $MPa^2$; $B_{sc}$ is a boundary of a sanding index corresponding to severe sanding in empirical qualitative sanding prediction, with a value of $1.5\times10^4$ $MPa^2$; and $S_I$ is the sanding inflow invasion index, which is dimensionless; and

S102, calculating the invasion site discrimination feature index:

the invasion site discrimination feature index being:

$$F_{SI}=S_I\times(W_{Lf}X_{Lf}+W_{hf}X_{hf}+W_{kwf}X_{kwf}) \quad (5);$$

in the formula, $F_{SI}$ is the invasion site discrimination feature index, which is dimensionless; $X_{Lf}$, $X_{hf}$, and $X_{kwf}$ are a single impact factor for a fracturing and packing fracture length, a single impact factor for a fracturing and packing fracture height, and a single impact factor for fracturing and packing fracture conductivity, respectively, which are dimensionless; and $W_{Lf}$, $W_{hf}$, and $W_{kwf}$ are weight coefficients of the single impact factor for the fracturing and packing fracture length, the single impact factor for the fracturing and packing fracture height, and an impact factor for fracturing and packing conductivity, respectively.

2. The combination parameter optimization design method for fracturing and packing dual-particle-size proppants for an unconsolidated sandstone reservoir according to claim 1, wherein the combination parameter optimization design method for fracturing and packing dual-particle-size proppants for an unconsolidated sandstone reservoir specifically comprises:

S1, calculating the invasion site discrimination feature index:

S101, obtaining a sanding inflow invasion index of a reservoir of the fracturing and packing well towards the fracture:

a calculation formula for the sanding inflow invasion index of the reservoir of the fracturing and packing well towards the fracture being:

$$S_I = 0.75 \times \frac{\Delta P}{\Delta P_c} + 0.25 \times \frac{B_{sc}}{B_s}; \quad (1)$$

in the above formula, $\Delta P$ is an average production pressure difference of an oil well, MPa; $\Delta P_c$ is a critical production pressure difference for sanding of the oil well, MPa; $B_s$ is a sanding index of the reservoir, $MPa^2$; $B_{sc}$ is a boundary of a sanding index corresponding to severe sanding in empirical qualitative sanding prediction, with a value of $1.5\times10^4$ $MPa^2$; and $S_I$ is the sanding inflow invasion index, which is dimensionless; and

S102, calculating the invasion site discrimination feature index:

the invasion site discrimination feature index being:

$$F_{SI}=S_I\times(W_{Lf}X_{Lf}+W_{hf}X_{hf}+W_{kwf}X_{kwf}) \quad (5);$$

in the formula, $F_{SI}$ is the invasion site discrimination feature index, which is dimensionless; $X_{Lf}$, $X_{hf}$, and $X_{kwf}$ are a single impact factor for a fracturing and packing fracture length, a single impact factor for a fracturing and packing fracture height, and a single impact factor for fracturing and packing fracture conductivity, respectively, which are dimensionless; and $W_{Lf}$, $W_{hf}$, and $W_{kwf}$ are weight coefficients of the single impact factor for the fracturing and packing fracture length, the single impact factor for the fracturing and packing fracture height, and an impact factor for fracturing and packing conductivity, respectively;

S2, optimizing a packing sequence and a fracture length ratio of dual-particle-size proppants for a fracturing and packing well:

S201, determining flow patterns of a reservoir fluid and the formation sand towards the fracture based on the $F_{SI}$ index:

if $F_{SI}>1.15$, the flow pattern of the reservoir fluid and the formation sand towards the fracture being a pattern A;

if $F_{SI}<0.85$, the flow pattern of the reservoir fluid and the formation sand towards the fracture being a pattern B;

if $0.85\leq F_{SI}\leq 1.15$, the flow pattern of the reservoir fluid and the formation sand towards the fracture being neither the pattern A nor the pattern B;

wherein the pattern A is: an area near a toe of the fracture is a severe invasion area, and an area near a root of the fracture is a slight invasion area; and the pattern B is: the area near the root of the fracture is a severe invasion area, and the area near the toe of the fracture is a slight invasion area;

S202, designing a packing fracture length ratio and a packing sequence of the coarse-particle-size proppant and the fine-particle-size proppant based on the flow patterns and the $F_{SI}$ index:

when $2.0<F_{SI}$, the packing fracture length ratio between the coarse-particle-size proppant and the fine-particle-size proppant being 7:3;

when $1.75<F_{SI}\leq 2.0$, the packing fracture length ratio between the coarse-particle-size proppant and the fine-particle-size proppant being 6:4;

when $1.55<F_{SI}\leq 1.75$, the packing fracture length ratio between the coarse-particle-size proppant and the fine-particle-size proppant being 5:5;

when $1.25<F_{SI}\leq 1.55$, the packing fracture length ratio between the coarse-particle-size proppant and the fine-particle-size proppant being 4:6;

when $1.15<F_{SI}\leq 1.25$, the packing fracture length ratio between the coarse-particle-size proppant and the fine-particle-size proppant being 3:7;

when $0.7\leq F_{SI}<0.85$, the packing fracture length ratio between the fine-particle-size proppant and the coarse-particle-size proppant being 7:3;

when $0.55\leq F_{SI}<0.7$, the packing fracture length ratio between the fine-particle-size proppant and the coarse-particle-size proppant being 6:4;

when $0.4\leq F_{SI}<0.55$, the packing fracture length ratio between the fine-particle-size proppant and the coarse-particle-size proppant being 5:5;

when $0.25\leq F_{SI}<0.4$, the packing fracture length ratio between the fine-particle-size proppant and the coarse-particle-size proppant being 4:6;

when $F_{SI}<0.25$, the packing fracture length ratio between the fine-particle-size proppant and the coarse-particle-size proppant being 3:7; wherein the packing sequence is based on a rule of packing the fine-particle-size proppant in the severe invasion area and packing the coarse-particle-size proppant in the slight invasion area;

S3, optimizing combined coarse and fine particle sizes of the dual-particle-size proppants for the fracturing and packing well:

a design method for the median particle size of the fine-particle-size proppant being:

$$D_{g50a} = (S_I)^{-0.5} \cdot \left(\frac{J_s}{5.0}\right)^{-0.25} \cdot 5.5 \cdot d_{s50}; \tag{6}$$

wherein in the formula, $S_I$ is the sanding inflow invasion index, which is dimensionless; $J_s$ is the uniformity coefficient of the formation sand, which is dimensionless; $d_{s50}$ is the median particle size of the formation sand, mm; and $D_{g50a}$ is the design value of the median particle size of the fine-particle-size proppant, mm;

when $D_{g50a}<0.3$, selecting the fine-particle-size proppant with a particle size of 0.3-0.6 mm, and selecting the coarse-particle-size proppant with a particle size of 0.3-0.6 mm;

when $0.33\leq D_{g50a}<0.6$, selecting the fine-particle-size proppant with a particle size of 0.3-0.6 mm, and selecting the coarse-particle-size proppant with a particle size of 0.4-0.8 mm;

when $0.6\leq D_{g50a}<0.8$, selecting the fine-particle-size proppant with a particle size of 0.4-0.8 mm, and selecting the coarse-particle-size proppant with a particle size of 0.6-1.2 mm; and when $0.8\leq D_{g50a}$, selecting the fine-particle-size proppant with a particle size of 0.6-1.2 mm, and selecting the coarse-particle-size proppant with a particle size of 0.6-1.2 mm.

3. The combination parameter optimization design method for fracturing and packing dual-particle-size proppants for an unconsolidated sandstone reservoir according to claim 2, wherein values of $W_{Lf}$, $W_{hf}$, and $W_{kwf}$ are 0.45±0.02, 0.25±0.02, and 0.3±0.02, respectively.

4. The combination parameter optimization design method for fracturing and packing dual-particle-size proppants for an unconsolidated sandstone reservoir according to claim 2, wherein the single impact factor for the fracturing and packing fracture length $X_{Lf}$ is:

$$X_{Lf} = \alpha \cdot \frac{R_e - L_f}{R_e}; \tag{2}$$

in the formula, $X_{Lf}$ is the single impact factor for the fracturing and packing fracture length, which is dimensionless; $R_e$ is a reservoir radius controlled by the oil well, m; $L_f$ is a single-wing fracture length of the fracture, m; and $\alpha$ is a correction coefficient for the fracturing and packing fracture length.

5. The combination parameter optimization design method for fracturing and packing dual-particle-size proppants for an unconsolidated sandstone reservoir according to claim 4, wherein a value of the correction coefficient for the fracturing and packing fracture length $\alpha$ is 1.5385.

6. The combination parameter optimization design method for fracturing and packing dual-particle-size proppants for an unconsolidated sandstone reservoir according to claim 2, wherein the single impact factor for the fracturing and packing fracture height $X_{hf}$ is:

$$X_{hf} = \beta \cdot \frac{h_f}{H_e}; \tag{3}$$

in the formula, $X_{hr}$ is the single impact factor for the fracturing and packing fracture height, which is dimensionless; $H_e$ is a reservoir thickness, m; $h_f$ is a fracture height, m; and $\beta$ is a correction coefficient for the fracturing and packing fracture height.

7. The combination parameter optimization design method for fracturing and packing dual-particle-size proppants for an unconsolidated sandstone reservoir according to claim 6, wherein a value of the correction coefficient for the fracturing and packing fracture height $\beta$ is 1.058.

8. The combination parameter optimization design method for fracturing and packing dual-particle-size proppants for an unconsolidated sandstone reservoir according to claim 2, wherein the single impact factor for the fracturing and packing fracture conductivity $X_{kwf}$ is:

$$X_{kwf} = \gamma \cdot \left(\frac{k_f}{K_e}\right)^{0.25} \cdot \left(\frac{w_f}{0.5\pi R_e}\right)^{0.25}; \tag{4}$$

in the formula, $X_{kwf}$ is the single impact factor for the fracturing and packing conductivity, which is dimensionless; $K_e$ is a reservoir permeability, D; $k_f$ is a fracture packing permeability, D; $w_f$ is a fracture width, mm; $\gamma$ is a correction coefficient for the fracturing and packing fracture conductivity; and $R_e$ is the reservoir radius controlled by the oil well, m.

9. The combination parameter optimization design method for fracturing and packing dual-particle-size proppants for an unconsolidated sandstone reservoir according to claim 8, wherein a value of the correction coefficient for the fracturing and packing fracture conductivity $\gamma$ is 2.15.

10. The combination parameter optimization design method for fracturing and packing dual-particle-size proppants for an unconsolidated sandstone reservoir according to claim 2, wherein volume dosages of coarse and fine proppants are calculated based on the packing fracture length ratio between the coarse-particle-size proppant and the fine-particle-size proppant and fracture geometry parameters.

* * * * *